US005919745A

United States Patent [19]

Cala et al.

[11] Patent Number: 5,919,745

[45] Date of Patent: Jul. 6, 1999

[54] LIQUID LAUNDRY DETERGENT COMPOSITION CONTAINING NONIONIC AND AMPHOTERIC SURFACTANTS

[75] Inventors: Francis R. Cala, Highland Park, N.J.; Charles D. Carr, Yardley, Pa.; John Ip, Princeton, N.J.

[73] Assignee: Church & Dwight Co., Inc, Princeton, N.J.

[21] Appl. No.: 08/893,866

[22] Filed: Jul. 11, 1997

[51] Int. Cl.[6] ..... C11D 1/88; C11D 1/94; C11D 3/10; C11D 3/30

[52] U.S. Cl. ..... 510/340; 510/119; 510/123; 510/125; 510/130; 510/235; 510/237; 510/276; 510/405; 510/409; 510/421; 510/422; 510/426; 510/428; 510/434; 510/435; 510/478; 510/480; 510/490; 510/511

[58] Field of Search ..... 510/119, 123, 510/125, 130, 235, 237, 340, 405, 409, 421, 422, 426, 428, 434, 435, 478, 480, 490, 511, 276

[56] References Cited

U.S. PATENT DOCUMENTS

| | | | |
|---|---|---|---|
| 3,762,859 | 10/1973 | Wixon et al. | 8/18 |
| 3,886,075 | 5/1975 | Bernardino | 252/8.75 |
| 4,009,256 | 2/1977 | Nowak, Jr. et al. | 424/70 |
| 4,080,310 | 3/1978 | Ng et al. | 252/544 |
| 4,378,300 | 3/1983 | Gray | 252/99 |
| 4,414,128 | 11/1983 | Goffinet | 252/111 |
| 4,430,244 | 2/1984 | Broze et al. | 252/94 |
| 4,544,494 | 10/1985 | Downey et al. | 252/135 |
| 4,992,194 | 2/1991 | Liberati et al. | 252/99 |
| 5,004,557 | 4/1991 | Nagarajan et al. | 252/174.24 |
| 5,308,530 | 5/1994 | Aronson et al. | 252/174.12 |
| 5,540,853 | 7/1996 | Trinh et al. | 510/101 |

*Primary Examiner*—Mark Kopec
*Assistant Examiner*—Charles Boyer
*Attorney, Agent, or Firm*—Irving Fishman

[57] ABSTRACT

A liquid aqueous laundry detergent composition having improved cleaning properties and comprising a nonionic surfactant; about 0.25 to about 20 wt. % of an N—$C_8$—$C_{20}$ alkyl and/or N-unsaturated $C_{16}$–$C_{18}$ hydrocarbyl amine of a $C_1$–$C_7$ monocarboxylic acid or salt thereof as an amphoteric surfactant; an alkaline substance in an amount sufficient to cause the wash liquor containing said detergent composition to have a pH of about 8 to about 11 determined ten minutes after the initiation of washing under standard conditions; and about 30 to about 95 wt. % of water, based on the total weight of the composition.

17 Claims, No Drawings

LIQUID LAUNDRY DETERGENT COMPOSITION CONTAINING NONIONIC AND AMPHOTERIC SURFACTANTS

BACKGROUND OF THE INVENTION

1. Field of the Invention

This invention relates to improved aqueous liquid laundry detergent compositions.

2. Background Information Including Description of Related Art

Laundry detergent compositions are sold as either solid, i.e., powder or granular compositions, or liquid compositions. The advantages of liquid over solid compositions are that the caking tending to occur with solid compositions is avoided, the liquid composition is more easily dispersed in wash water, and a liquid is more easily measured and added to the washing machine without spillage than is a solid composition. However, while the cleaning ability of liquid detergents is generally satisfactory, there exist circumstances under which even better cleaning performance would be advantageous. Thus, any expedient which results in a liquid detergent composition having such improved cleaning performance is very desirable.

U.S. Pat. No. 5,004,557, issued Apr. 2, 1991 to Nagarajan et al., teaches aqueous liquid laundry detergent compositions comprising a surfactant, a water-soluble sequester builder, and 0.1 to 2% of a homopolymer or copolymer of acrylic acid having a molecular weight in excess of 100,000 as an anti-redeposition and viscosity control agent. The surfactant may be anionic such as an alkylbenzenesulfonate, nonionic such as a condensation product of ethylene oxide with a $C_8$–$C_{18}$ primary or secondary aliphatic alcohol, amphoteric such as an N-alkylamino acid, or a combination of such surfactants.

U.S. Pat. No. 5,308,530, issued May 3, 1994 to Aronson et al., discloses a liquid detergent composition comprising a surfactant which may be anionic, nonionic, cationic, zwitterionic or ampholytic, or any combination thereof; a calcium-stabilized enzyme; and as a builder or anti-redeposition agent, a copolymer of an unsaturated carboxylic acid and a hydrophobic monomer prepared by solution polymerization.

SUMMARY OF THE INVENTION

In accordance with this invention, a liquid aqueous detergent composition is provided which comprises at least one nonionic surfactant; about 0.25 to about 20 wt. % of an N—$C_8$—$C_{20}$ alkyl and/or N-unsaturated $C_{16}$–$C_{18}$ hydrocarbyl amine of a $C_1$–$C_7$ monocarboxylic acid or salt thereof as an amphoteric surfactant; an alkaline substance in an amount sufficient to cause the wash liquor containing said detergent composition to have a pH of about 8 to about 11, determined ten minutes after the initiation of washing under standard conditions; and a total water content of about 30 to about 95 wt. %. All of the foregoing weight percentages, as well as those given hereinafter, are based on the total weight of the complete detergent composition unless otherwise defined.

It has been found that the detergent compositions of this invention containing the nonionic and particular amphoteric surfactants and the alkaline substance in the specified quantity, have an improved ability to remove soils caused by certain oily or fatty deposits, as compared with detergent compositions not containing both of such amphoteric surfactant and quantity of alkaline substance.

Specific nonionic surfactants which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of non ionic surfactants are the ethoxylated linear alcohols (LAE), such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 7 moles of ethylene oxide per mole of alcohol.

The amphoteric surfactant in the detergent compositions of this invention is preferably an N-alkyl and/or unsaturated hydrocarbyl amine of an alkanoic acid or a salt thereof having the following formula:

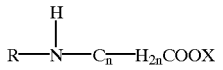

wherein R is one or more alkyl groups each containing about 8 to about 20 carbon atoms, and/or one or more monovalent unsaturated hydrocarbyl groups each containing 1 to 3 ethylenic bonds and about 16 to about 18 carbon atoms, X is hydrogen or a monovalent cation, preferably alkali metal, and n is zero or an integer of 1 to about 6. Preferably, a major amount, i.e., at least 50 wt. % of the R groups are linear (straight chain) alkyl containing 12 to 16 carbon atoms and n is 1 to 3, most preferably 2. Specific amphoteric surfactants which may be used (free acid or alkali metal salt) are N-coco-β-aminopropionic acid wherein "coco" indicates a mixture of alkyl and unsaturated hydrocarbyl groups corresponding to the fatty acids of coconut oil; N-lauryl(70 wt. %), myristyl(30 wt. %)-β-aminopropionic acid; N-coco-γ-aminobutyric acid; N-lauryl(70 wt. %), myristyl(30 wt. %)-γ-aminobutyric acid; N-coco-glycine; and N-lauryl(70 wt. %), myristyl(30 wt. %) glycine. The preferred amphoteric surfactant is N-coco-β-aminopropionic acid or its sodium salt. The amphoteric surfactant may be added to the composition as the free acid or alkali metal salt of the acid. However, regardless of the form in which the surfactant is added, it will exist in the composition in ionic form, i.e., as a salt of the acid, after the alkaline substance is added to the composition.

Optionally, one or more anionic detergents may be included in the composition, and this is often preferred. The contemplated water soluble anionic detergent surfactants are the alkali metal (such as sodium and potassium) salts of the higher linear alkylbenzenesulfonates (LAS) and the alkali metal salts of sulfated ethoxylated and unethoxylated fatty alcohols, and ethyoxylated alkylphenols. The particular salt will be suitably selected depending upon the particular formulation and the proportions therein.

If a sodium alkylbenzenesulfonate surfactant, is used in the composition of the present invention, it preferably has a linear (straight chain) alkyl radical of average length of about 11 to 13 carbon atoms (LAS).

Specific sulfated surfactants which can be used in the compositions of the present invention include sulfated ethoxylated and unethoxylated fatty alcohols, preferably linear (straight chain) primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles of EO per mole of alkyl phenol. Preferred among this class of anionic surfactants are the sulfated ethoxylated linear alcohols (AES), such as the $C_{12}$–$C_{16}$ alcohols ethoxylated with an average of from about 1 to about 12 moles of ethylene oxide per mole of alcohol. A most preferred sulfated ethoxylated detergent is made by sulfating a $C_{12}$–$C_{15}$ alcohol ethoxylated with 3 moles of ethylene oxide per mole of alcohol.

The total active surfactant in the composition may be in the range, for example, of about 5 to about 60 wt. % preferably about 8 to about 30 wt. %. with the amphoteric surfactant being present, for example, in an amount of about 0.25 to about 20 wt. %, preferably about 0.5 to about 4 wt. % calculated as the free acid, and the nonionic surfactant (if no surfactant is present other than the nonionic and amphoteric surfactants) being present, for example, in amount of about 1 to about 59.75 wt. %, preferably about 5 to about 25 wt. %. If, as preferred, the active surfactant consists of a combination of nonionic, anionic, and amphoteric surfactants, then the nonionic surfactant may be present in the range, for example of about 1 to about 50 wt. %, preferably about 5 to about 25 wt. %, and the anionic surfactant may be present in the range, for example, of about 1 to about 50 wt. %, preferably about 1 to about 25 wt. %,, calculated as the sodium salt, all percentages based on the total weight of the composition.

As stated, the liquid detergent contains an alkaline substance in an amount sufficient to cause the wash liquor to have a pH of about 8 to about 11 ten minutes after initiation of washing, assuming a standard amount of detergent and a wash liquor volume of about 70 liters. Note that this amount of alkaline substance is in excess of that required to neutralize any amphoteric and/or anionic surfactant added as the free acid, since the latter amount generally brings the pH of the composition up to only about 7.

The alkaline substance present in the liquid detergent composition of this invention may be, for example, a water-soluble alkaline carbonate, e.g., an alkali metal carbonate, bicarbonate or sesquicarbonate, preferably sodium or potassium carbonate, bicarbonate or sesquicarbonate, and most preferably sodium carbonate. If sodium carbonate is utilized, it may be present in an amount of about 0.1 to about 10 wt. %, preferably about 1 to about 4 wt. %.

The alkaline substance may also be an alkanolamine, preferably a trialkanolamine, wherein the alkanol group contain from about 1 to about 9 carbon atoms. The preferred alkaline substance from this class is triethanolamine (TEA). If triethanolamine is utilized as the alkaline substance, it may be present in an amount, for example, of about 3 to about 25 wt. %, preferably about 4 to about 10 wt. %.

Other alkaline substances are also suitable, e.g., an alkali metal hydroxide, such as sodium or potassium hydroxide, and sodium silicate.

Optionally, the liquid detergent composition of this invention may contain an at least partially neutralized carboxylic acid containing polymer as a soil antireposition agent. The carboxylic acid-containing polymer (before partial or complete neutralization) may be, for example, a homopolymer or copolymer (composed of two or more co-monomers) of an α,β-monoethylenically unsaturated acid monomer containing no more than nine, preferably no more than seven carbon atoms, such as acrylic acid, methacrylic acid, a diacid such as maleic acid, itaconic acid, fumaric acid, mesoconic acid, citraconic acid and the like, a monoester of a diacid with an alkanol, e.g., having 1–5 carbon atoms, and mixtures thereof. In addition to a homopolymer, the polymer may be, for example, a copolymer of monomers consisting of more than one of the foregoing unsaturated carboxylic acid monomers, e.g., acrylic acid and maleic acid, or a copolymer of monomers consisting of at least one of such unsaturated carboxylic acid monomers with at least one mon-carboxylic acid, α,β-monoethylenically unsaturated monomer containing no more than nine, preferably no more than seven carbon atoms, which may be either non-polar such as styrene or an olefin, such as ethylene, propylene or butene-1, or which has a polar functional group such as vinyl acetate, vinyl chloride, vinyl alcohol, an alkyl acrylate, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., a copolymer of acrylic acid and acrylamide by partially hydrolyzing a polyacrylamide.

Copolymers of monomers consisting of at least one unsaturated carboxylic acid monomer with at least one non-carboxylic acid comonomer should contain at least about 50 mol % of the polymerized carboxylic acid monomer.

Particularly preferred carboxylic acid-containing polymers are homopolymers of one of the foregoing unsaturated carboxylic acids and copolymers of monomers consisting of more than one of such unsaturated carboxylic acids; more preferred are copolymers of acrylic acid and maleic acid; and most preferred are copolymers of about 50 to about 95 wt. % of acrylic acid and about 5 to about 50 wt. % of maleic acid based on the weight of the copolymer.

The carboxylic acid-containing polymer has a number average molecular weight of, for example, up to about 10,000, preferably about 1000 to about 10,000, and more preferably about 2000 to about 5000. To ensure substantial water solubility, the polymer may be completely or partially neutralized, e.g., with alkali metal ions, preferably sodium ions, before being combined with the other components of the composition.

If used, the carboxylic acid-containing polymer may be present in an amount, for example, of about 0.025 to about 1.9 wt. %, preferably about 0.05 to about 0.9 wt. %, calculated as solid unneutralized polymer and based on the total weight of the composition. When completely or partially neutralized with alkali metal cations, the polymer salt is present in an amount somewhat greater than that of the corresponding unneutralized polymer because of the greater weight of the neutralizing cations over the replaced hydrogen of the unneutralized polymer.

The liquid detergent compositions of this invention may also optionally contain sodium silicate which acts as a sequestrant builder effecting the sequestration of calcium and particularly magnesium ions in the wash water, and to provide some alkalinity for the purpose of keeping the anionic surfactant in neutral salt form and thus at maximum solubility. If used, the sodium silicate may be present in the range, for example, of about 0.2 to about 3 wt. %, preferably about 1.0 to about 2.0 wt. % based on the total weight of the composition. As suggested previously, sodium silicate may also act as the alkaline substance of this invention, if used in an amount sufficient to obtain a pH of the wash liquor within the defined range of about 8 to about 11 ten minutes after initiation of washing.

The composition may also optionally contain a chelating agent initially added to the water from which the liquid detergent composition is prepared to sequester metal ions which have an adverse effect on the detergent properties of the composition. Particularly suitable chelating agents are salts of ethylenediaminetetraacetic acid (EDTA), e.g., the tetra sodium salt ($Na_4EDTA$). If the $Na_4EDTA$ is used, it may be present in an amount, for example, of about 0.01 to about 2 wt. %, preferably about 0.02 to about 0.1 wt. %, based on the total weight of the composition.

In addition to the foregoing components, various conventional water-soluble adjuvants of liquid laundry detergents may also be present, such as, for example, optical brighteners, enzymes, dyes and perfumes.

All of the contemplated components are dissolved or dispersed in water which is present in the final composition in an amount of, for example, about 30 to about 95 wt. %, preferably about 50 to about 92 wt. %, and more preferably about 70 to about 90 wt. %, based on the total weight of the composition.

The following examples show the effect of adding a contemplated amphoteric surfactant and varying amounts of an alkaline substance (soda ash or TEA) to a liquid detergent composition containing typical amounts of nonionic and anionic surfactants. The numbered examples illustrate the cleaning performance of compositions under the invention which contain both a contemplated amphoteric surfactant and an alkaline substance to raise the pH of the wash liquor, while the comparative lettered examples show for comparison the cleaning performance of compositions containing either the amphoteric surfactant, the alkanine substance, or neither of such components.

EXAMPLES 1 AND 2 AND COMPARATIVE EXAMPLES A TO D

In this series of examples, a group of aqueous liquid laundry detergent compositions were prepared, each of which contained as a minimum, 4 grams of a sodium alkylbenzenesulfonate in which the alkyl radicals are linear (straight chain) and have an average length of about 11 to 13 carbon atoms (LAS, an anionic surfactant); 2 grams of the sodium salt of a sulfated $C_{12}$–$C_{15}$ alcohol ethoxylated with 3 moles of ethylene oxide per mole of alcohol (AES, an anionic surfactant) together with 1.33 grams of ethanol to solubilize the latter anionic surfactant for compounding; and 18 grams of a linear (straight chain) $C_{12}$–$C_{15}$ alcohol ethoxylated with 7 moles of ethylene oxide per mole of alcohol (LAE, a nonionic surfactant); all dissolved in varying amounts of water which constituted about 85–90 wt. of the composition. The composition of Comparative Example A, the control example, did not contain any other components, while the remaining examples contained either 4 grams of sodium-N-coco-β-aminopropionate, an amphoteric surfactant, obtained from Henkel under the trademark "Deriphat 151C"; 30 grams of sodium carbonate (soda ash) or triethanolamine (TEA) as an alkaline substance to raise the pH of the wash liquor; or both the latter amounts of amphoteric surfactant and alkaline substance. The designation "coco" in the chemical name of the amphoteric surfactant represents a distribution of R groups corresponding in number of carbon atoms and structure to the fatty acids in coconut oil, such that the R groups were made up of 3 wt. % octyl, 5 wt. % decyl, 50 wt. % dodecyl, 23 wt. % tetradecyl, 11 wt. % hexadecyl, 5 wt. % oleyl and 3 wt. % stearyl.

Following the procedure of ASTM D-3050 utilizing full size Whirlpool washing machines, swatches of cotton and poly/cotton (a blend of 65 wt. % cotton and 35 wt. % polyester) soiled with various substances, were washed with the detergent compositions of the examples at 95° F. with the wash water containing 100 ppm of calcium and magnesium hardness with a Ca/Mg molar ratio of 3:1, such hardness calculated as $CaCO_3$ as described in ASTM D 1126–86 of October 1986. Four replicate soiled swatches were used for each determination, two in each of two machines. Reflectances of the clean unsoiled samples, the soiled samples and the washed samples were measured using a standard spectrophotometer, and the percent soil removal was calculated from the spectrophotometer measurements. The average percent soil removal for the various types of soiled samples are shown in Table I wherein "EMPA 101" indicates a soil of carbon black and olive oil on cotton, and "EMPA 104" indicates a soil of carbon black and olive oil on poly-cotton. Results obtained with these soilings and those of sebum on cotton and poly-cotton are an excellent indication of the cleaning power of a detergent composition. The acronym "EMPA" stands for "Eldgenossiche Materials Prufungs Anstalt," a Swiss government testing center.

Table I shows for each example, the amounts of amphoteric surfactant, soda ash, TEA and water in the composition of each example, and for each soiled sample cleaned with such composition, the percent soil removal achieved, with a plus sign (+) accompanying the percent soil removal indicating a statistically significant increase over the value obtained with the control composition of comparative Example A, a minus sign (–) indicating a statistically significant decrease, and an equal sign (=) indicating no statistical difference from that obtained with the control composition, such statistical significance or lack thereof, having been determined in accordance with least significant differences (LSD) as derived from a utilization of one way analysis of variance (ANOVA) per Statgraphics software package. Also shown is the pH of the wash liquor 10 minutes after the initiation of washing.

TABLE I

| | Example | | | | | |
|---|---|---|---|---|---|---|
| | A control | B | C | 1 | D | 2 |
| Amphoteric Surfactant, g | 0 | 4 | 0 | 4 | 0 | 4 |
| Soda Ash, g | 0 | 0 | 0 | 0 | 30 | 30 |
| TEA, g | 0 | 0 | 30 | 30 | 0 | 0 |
| Water, g | 214.7 | 220.7 | 484.7 | 490.7 | 484.7 | 490.7 |
| pH of Wash Liquor, 10 min | 7.3 | 7.4 | 8.8 | 8.8 | 10.3 | 10.3 |
| Soiled Sample, % Soil Removal | | | | | | |
| Sebum on Cotton | 52.8 | 51.7= | 57.5+ | 54.2= | 57.3+ | 61.2+ |
| EMPA 101 | 21.8 | 24.1+ | 26.2+ | 30.6+ | 28.7+ | 42.0+ |
| Sebum on Poly/Cotton | 54.4 | 52.4– | 70.3+ | 66.2+ | 71.8+ | 74.2+ |
| EMPA 104 | 26.1 | 26.6= | 25.3= | 34.7+ | 30.0+ | 45.2+ |

EXAMPLES 3–6 AND COMPARATIVE EXAMPLES E AND F

In this series of examples, the composition of Comparative Example E (the control composition) contained the same amounts of the same nonionic and anionic surfactants and ethanol as the control composition of Comparative Example A and in addition sodium silicate in an amount containing 1 gram of silica. The compositions of the remaining examples in the series contained the same amounts of the same nonionic and anionic surfactants and ethanol as the control composition of comparative Example E, but no silicate, and also contained 4 grams of the same amphoteric surfactant as in the previous series of examples and either no soda ash (Comparative Example F) or a variable amount of soda ash from 2 to 15 grams, and the compositions were subjected to the same cleaning trials as described in the previous series of examples. Table II shows the composition of each example, except for the nonionic and anionic surfactants which were constant as described and the sodium silicate which was only present in the control composition of comparative Example E, the pH of the wash liquor after 10 minutes of washing, and the results of the cleaning trials.

TABLE II

| | Example | | | | | |
|---|---|---|---|---|---|---|
| | E control | F | 3 | 4 | 5 | 6 |
| Amphoteric Surfactant, g | 0 | 4 | 4 | 4 | 4 | 4 |
| Soda Ash, g | 0 | 0 | 2 | 5 | 10 | 15 |
| Water, g | 223.3 | 220.7 | 238.7 | 265.7 | 310.7 | 355.7 |
| pH of Wash Liquor, 10 min | 8.5 | 7.6 | 8.9 | 9.5 | 9.8 | 10.0 |
| Soiled Sample, % Soil Removal | | | | | | |
| Sebum on Cotton | 53.7 | 51.9= | 53.6= | 57.4= | 53.2= | 56.0= |
| EMPA 101 | 27.7 | 24.4= | 32.8+ | 36.9+ | 39.7+ | 43.0+ |
| Sebum on Poly/Cotton | 61.4 | 53.7− | 60.0= | 67.1+ | 68.7+ | 70.7+ |
| EMPA 104 | 28.7 | 29.5= | 33.6+ | 38.4+ | 35.7+ | 41.2+ |

EXAMPLES 7–10 AND COMPARATIVE EXAMPLES G AND H

In this series of examples, compositions were tested which were similar to those of Examples 3–6 and Comparative Examples E and F, except that they contained variable amounts of triethanaolamine (TEA) rather than soda ash as the alkaline substance. The compositions of Comparative Examples G (the control) and H, which contained amphoteric surfactant but no TEA, were identical to those of Comparative Examples E and F, respectively. Table III shows the components of the compositions in addition to those of the control components, the pH of the wash liquor after 10 minutes of washing, and the results of the cleaning trials carried out as described in the previous examples.

TABLE III

| | Example | | | | | |
|---|---|---|---|---|---|---|
| | G control | H | 7 | 8 | 9 | 10 |
| Amphoteric Surfactant, g | 0 | 4 | 4 | 4 | 4 | 4 |
| TEA, g | 0 | 0 | 2 | 5 | 10 | 15 |
| Water, g | 223.3 | 220.7 | 238.7 | 265.7 | 310.7 | 355.7 |
| pH of Wash Liquor, 10 min | 8.7 | 7.7 | 8.0 | 8.4 | 8.6 | 8.8 |
| Soiled Sample, % Soil Removal | | | | | | |
| Sebum on Cotton | 52.5 | 53.2= | 53.4= | 57.8+ | 54.0= | 54.8= |
| EMPA 101 | 24.4 | 23.2= | 26.9= | 27.9+ | 29.7+ | 29.9+ |
| Sebum on Poly/Cotton | 59.7 | 52.9− | 56.1− | 64.5+ | 64.3+ | 65.7+ |
| EMPA 104 | 26.4 | 26.3= | 27.8= | 26.9= | 28.3= | 29.2= |

The results of the cleaning trials of Examples 1 to 10 and Comparative Examples A to H as shown in Tables I to III indicate that the compositions of Examples 1 to 10 under the invention yielded statistically significant improvements in the cleaning of EMPA 101 and 104 soilings as compared with the control compositions, which contained no amphoteric surfactant, much more often and greater in magnitude than did the compositions of the comparative examples, which either contained amphoteric surfactant but no soda ash or TEA as alkaline substance to raise the pH of the wash liquor above 8, or contained the alkaline substance but no amphoteric surfactant. Furthermore, these statistically significant improvements in the cleaning of EMPA 101 and 104 soilings by the compositions under the invention were often accompanied by similar improvements in the cleaning of sebum on cotton and/or poly/cotton soilings usually without any of the statistically significant reductions in the cleaning of sebum on poly/cotton soilings occurring with several of the compositions containing amphoteric surfactant but no alkaline substance to raise the pH of the wash liquor.

EXAMPLES 11 AND 12 AND COMPARATIVE EXAMPLES I TO L

In this series of examples, the control composition of Comparative Example I was identical to that of Comparative Example A and the composition of comparative Example J containing in addition 4 grams of amphoteric surfactant was identical to that of Comparative Example B. In the remaining examples, the composition contained in addition to the components of the control composition, either 1 or 3 grams of soda ash together with either 4 grams of amphoteric surfactant (Examples 11 and 12) or no amphoteric surfactant (Comparative Examples K and L). The components in addition to those of the control composition, the pH of the wash liquor 10 minutes after the initiation of washing, and the results of the cleaning trials are shown in Table IV.

TABLE IV

| | Example | | | | | |
|---|---|---|---|---|---|---|
| | I control | J | 11 | 12 | K | L |
| Amphoteric Surfactant, g | 0 | 4 | 4 | 4 | 0 | 0 |
| Soda Ash, g | 0 | 0 | 1 | 3 | 1 | 3 |
| Water, g | 214.7 | 250.7 | 259.7 | 277.7 | 223.7 | 241.7 |
| pH of Wash Liquor, 10 min | 7.5 | 7.6 | 8.0 | 9.1 | 8.0 | 9.1 |
| Soiled Sample, % Soil Removal | | | | | | |
| Sebum on Cotton | 49.8 | 47.0− | 48.1= | 51.1= | 48.6= | 49.5= |
| EMPA 101 | 19.8 | 23.6+ | 24.8+ | 31.4+ | 24.7+ | 26.0+ |
| Sebum on Poly/Cotton | 53.7 | 51.8− | 53.2= | 62.2+ | 54.4= | 65.7+ |
| EMPA 104 | 24.0 | 28.3+ | 28.9+ | 32.3+ | 23.4= | 24.8= |

The results shown in Table IV indicate that a composition containing amphoteric surfactant but no soda ash to raise the pH above 8 yielded statistically significant improvements in the cleaning of EMPA 101 and 104 soilings accompanied however by significant reductions in the cleaning of sebum on cotton and poly/cotton soilings. In contrast, compositions under the invention containing both amphoteric surfactant and soda ash to raise the pH above 8 yielded statistically significant improvements in the cleaning of EMPA 101 and 104 soilings with no statistically significant reductions in the cleaning of sebum on cotton and poly/cotton soilings. Finally, compositions containing soda ash to raise the pH to above 8 but no amphoteric surfactant resulted in statistically significant improvement in the cleaning of EMPA 101 soilings, but not EMPA 104 soilings.

EXAMPLES 13 AND 14 AND COMPARATIVE EXAMPLES M TO P

The procedure of Examples 11 and 12 and Comparative Examples I to L was repeated with the same detergent compositions except that in Examples 13 and 14 and Comparative Examples 0 and P, 5 and 10 grams triethanolamine (TEA) was substituted for the 1 and 3 grams of soda ash in the compositions of Examples 11 and 12 and Comparative Examples K and L. The control composition of Comparative Example M and the composition of Comparative Example N containing amphoteric surfactant but no added alkaline substance were identical to the compositions of Comparative Examples A and B. The amounts of variable components of the compositions, the pH ten minutes after the initiation of washing, and the results of the cleaning trials are shown in Table V.

TABLE V

| | Example | | | | | |
|---|---|---|---|---|---|---|
| | M control | N | 13 | 14 | O | P |
| Amphoteric Surfactant, g | 0 | 4 | 4 | 4 | 0 | 0 |
| TEA, g | 0 | 0 | 5 | 10 | 5 | 10 |
| Water, g | 214.7 | 250.7 | 295.7 | 340.7 | 259.7 | 304.7 |
| pH of Wash Liquor, 10 min | 7.5 | 7.5 | 8.2 | 8.5 | 8.2 | 8.4 |
| Soiled Sample, % Soil Removal | | | | | | |
| Sebum on Cotton | 49.5 | 50.2= | 49.7= | 50.7= | 47.3= | 51.8= |
| EMPA 101 | 22.1 | 25.0= | 26.8+ | 29.6+ | 25.8+ | 25.1= |
| Sebum on Poly/Cotton | 54.6 | 52.0− | 60.1+ | 63.9+ | 63.1+ | 66.2+ |
| EMPA 104 | 26.1 | 27.0= | 29.9+ | 32.7+ | 25.6= | 26.0= |

In the results of this series of examples shown in Table V, the compositions of Examples 13 and 14 under the invention which contained both amphoteric surfactant and TEA to raise the pH of the wash liquor above 8, each yielded significant improvements in the cleaning of EMPA 101 and 104 soilings accompanied by statistically significant improvements in the cleaning of sebum on poly/cotton soilings. In contrast, none of the compositions of the comparative examples, which either contained amphoteric surfactant and no TEA, or TEA and no amphoteric surfactant, resulted in a statistically significant improvement in the cleaning of both EMPA 101 and 104 soilings, and the presence of amphoteric surfactant and no TEA in the composition exhibited a statistically significant reduction in the cleaning of the sebum on poly/cotton soiling.

We claim:

1. A liquid, aqueous, laundry detergent composition consisting essentially of a nonionic surfactant; an anionic surfactant; about 0.25 to about 20 wt. % of an amphoteric surfactant; an alkaline substance selected from the group consisting of water-soluble alkaline carbonates and alkanolamines, in an amount sufficient to cause the wash liquor containing said detergent composition to have a pH of about 8 to about 11 determined ten minutes after the initiation of washing under standard conditions; and about 30 to about 95 wt. % of water, said weight percentages based on the total weight of the composition, said amphoteric surfactant having the formula

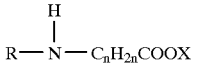

wherein R is one or more alkyl groups each containing about 8 to about 20 carbon atoms and/or one or more monovalent unsaturated hydrocarbyl groups each containing 1 to 3 ethylenic bonds and about 16 to about 18 carbon atoms, with a major amount of the R groups containing about 12 to about 16 carbon atoms; X is hydrogen or a monovalent cation; and n is zero or an integer of 1 to about 6, and said detergent composition optionally containing one or more of a partially neutralized carboxylic acid-containing polymer of at last 50 mol % of an ethylenically unsaturated carboxylic acid monomer as a soil antiredeposition agent; sodium silicate as sequestrant builder; and a chelating agent.

2. The composition of claim 1 wherein, in the formula for the amphoteric surfactant, a major amount of R groups are linear (straight chain) alkyl groups containing 12 to 16 carbon atoms, and n is 1 to 3.

3. The composition of claim 2 wherein n is 2.

4. The composition of claim 3 wherein said amphoteric surfactant is N-coco-β-aminopropionic acid or its sodium salt.

5. The composition of claim 1 wherein said alkaline substance is an alkaline carbonate.

6. The composition of claim 5 wherein said alkaline carbonate is sodium carbonate.

7. The composition of claim 1 wherein said alkaline substance is an alkanolamine.

8. The composition of claim 7 wherein said alkanolamine is triethanolamine.

9. The composition of claim 1 comprising about 5 to about 60 wt. % of total surfactant.

10. The composition of claim 1 wherein said nonionic surfactant comprises $C_{12}$–$C_{16}$ linear alcohols ethoxylated with an average of 1 to 12 moles of ethylene oxide per mole of alcohol and is present in an amount of about 1 to about 50 wt. %.

11. The composition of claim 1 wherein said anionic surfactant comprises alkali metal salts of an alkylbenzenesulfonic acid and a sulfated linear $C_{12}$–$C_{16}$ alcohol ethoxylated with an average of 1 to 12 moles of ethylene oxide per mole of alcohol, and is present in an amount of about 1 to about 50 wt. %.

12. The composition of claim 1 also comprising a partially neutralized carboxylic acid-containing polymer of at least 50 mol % of an ethylenically unsaturated carboxylic acid monomer as a soil antiredeposition agent.

13. The composition of claim 1 also containing sodium silicate as a sequestrant builder.

14. The composition of claim 1 also containing a chelating agent.

15. The composition of claim 9 wherein said chelating agent is a salt of ethylenediaminotetraacetic acid (EDTA).

16. The composition of claim 9 wherein said salt is the tetrasodium salt of EDTA.

17. A process comprising washing a fabric in an aqueous wash liquor containing the composition of claim 1.

* * * * *